US007624986B2

(12) United States Patent
Nicely

(10) Patent No.: US 7,624,986 B2
(45) Date of Patent: Dec. 1, 2009

(54) METHOD OF CONDUCTING WAGERING DICE GAMES

(75) Inventor: Mark C. Nicely, Daly City, CA (US)

(73) Assignee: IGT, Reno, NV (US)

( * ) Notice: Subject to any disclaimer, the term of this patent is extended or adjusted under 35 U.S.C. 154(b) by 180 days.

(21) Appl. No.: 11/187,354

(22) Filed: Jul. 21, 2005

(65) Prior Publication Data

US 2006/0017225 A1 Jan. 26, 2006

Related U.S. Application Data

(60) Provisional application No. 60/589,675, filed on Jul. 21, 2004.

(51) Int. Cl.
*A63F 9/04* (2006.01)

(52) U.S. Cl. ..... 273/146

(58) Field of Classification Search ..... 273/146
See application file for complete search history.

(56) References Cited

U.S. PATENT DOCUMENTS

| | | | | |
|---|---|---|---|---|
| 5,324,041 | A * | 6/1994 | Boylan et al. | 273/292 |
| 6,305,686 | B1 * | 10/2001 | Perrie et al. | 273/146 |
| 6,508,469 | B2 * | 1/2003 | Promutico | 273/274 |
| 6,585,588 | B2 * | 7/2003 | Hartl | 463/16 |
| 6,746,016 | B2 * | 6/2004 | Perrie et al. | 273/138.1 |
| 6,761,353 | B2 * | 7/2004 | Berman et al. | 273/143 R |
| 7,032,901 | B2 * | 4/2006 | Perrie et al. | 273/138.1 |
| 7,152,863 | B2 * | 12/2006 | Scheb et al. | 273/274 |
| RE39,770 | E * | 8/2007 | Promutico | 273/274 |
| 2001/0034264 | A1 * | 10/2001 | Berman et al. | 463/22 |
| 2002/0036380 | A1 * | 3/2002 | Perrie et al. | 273/146 |
| 2004/0242306 | A1 * | 12/2004 | Tarantino | 463/16 |
| 2004/0251626 | A1 * | 12/2004 | Porter et al. | 273/146 |
| 2005/0161879 | A1 * | 7/2005 | Scheb et al. | 273/138.1 |
| 2006/0116194 | A1 * | 6/2006 | Pacey et al. | 463/20 |
| 2006/0135242 | A1 * | 6/2006 | Tarantino | 463/16 |
| 2007/0075490 | A1 * | 4/2007 | Gak | 273/146 |
| 2007/0135207 | A1 * | 6/2007 | Tarantino | 463/22 |

OTHER PUBLICATIONS

Yahtzeee Instructions written by Hasbro, published in 1999.

Yahtzee Instruction written by Milton Bradley Company, published in 1995.

(Continued)

*Primary Examiner*—Gene Kim
*Assistant Examiner*—Dolores Collins
(74) *Attorney, Agent, or Firm*—K&L Gates, LLP

(57) ABSTRACT

A method of conducting a wagering game using dice is disclosed. The method is ideally suited for video-based machines or Internet-based applications. However, it may be conducted in a live environment. Dice comprising multiple characteristics (e.g., values and colors) are used to generate random outcomes. Players may place wagers on value outcomes and color outcomes. Multiple groups of distinct dice may be used to create a game matrix having multiple pay lines which afford players multiple wager options. In one electronic version five dice are used. A player places a wager and then four of the five dice values are generated and revealed. With four of the five values known, possible winning outcomes are highlighted from a pay table listing all winning outcomes. In this version, there are always possible winning outcomes after four of the five dice have been revealed. Bonus trigger outcomes are also discussed.

23 Claims, 17 Drawing Sheets

OTHER PUBLICATIONS

Balls Game Description [online] [retrieved on Dec. 6, 2007, available prior to Jul. 21, 2005]. Retrieved from the Internet at <URL: http://games.ladbrokes.com/gameinfo.php?gameID=1&wintype=rules>.

Balls Help Description [online] [retrieved on Dec. 6, 2007, available prior to Jul. 21, 2005]. Retrieved from the Internet at <URL: http://games.ladbrokes.com/gameinfo.php?gameID=1&wintype=help>.

Vacation USA Game Description [online] [retrieved on Dec. 6, 2007, available prior to Jul. 21, 2005]. Retrieved from the Internet at <URL: http://www.skybetvegas.com/Common/HTML/gameshelp/game_help_0017_0.html.com>.

Multi-Hand Blackjack Game Description [online] [retrieved on Dec. 6, 2007, available prior to Jul. 21, 2005]. Retrieved from the Internet at <URL: http://www.skybetvegas.com/Common/HTML/gameshelp/game_help_0035_0.html.com>.

BanannaRama Deluxe Game Description [online] [retrieved on Dec. 6, 2007, available prior to Jul. 21, 2005]. Retrieved from the Internet at <URL: http://www.skybetvegas.com/Common/HTML/gameshelp/game_help_0003_0.html.com>.

The Price is Right 5 wheel with Plinko Game Description [online] [retrieved on Dec. 6, 2007, available prior to Jul. 21, 2005]. Retrieved from the Internet at <URL: http://www.skybetvegas.com/Common/HTML/gameshelp/game_help_0019_0.html.com>.

* cited by examiner

METHOD OF CONDUCTING WAGERING DICE GAMES

CROSS-REFERENCE TO RELATED APPLICATIONS

This application claims the benefit of Provisional Application No. 60/589,675 filed Jul. 21, 2004.

FIELD OF THE INVENTION

The embodiments of the present invention comprise a method playing a number of dice-based games appropriate for player vs. machine or player vs. player.

BACKGROUND

There are a couple of games involving five dice which are referred to as poker dice. In the most traditional sense, poker dice is a dice equivalent of a five-card poker game. Two or more players compete against each other and the player with the best outcome, defined by an established hierarchy like in card-based poker, wins the game. An example of a possible outcome hierarchy is:

- 5 of a kind (all 5 dice have same pip value, e.g. 2-2-2-2-2)
- 4 of a kind (4 dice have same pip value, the other die does not match, e.g. 2-2-2-2-5)
- Full House (3 dice have same pip value and 2 other dice have a different matching pip value, e.g. 2-2-2-5-5)
- Straight (the 5 dice pip values are in sequential order, i.e. 1-2-3-4-5 or 2-3-4-5-6)
- Three of a kind (3 dice have same pip value, the other dice do not match, e.g. 2-2-2-4-5)
- Two Pair: (2 dice have the same pip value, 2 other dice have a different matching pip value, the fifth dice does not match, e.g. 2-2-5-5-3)
- One Pair (2 dice have same pip value, the other dice do not match, e.g. 2-2-3-4-6)

Poker dice can be played as a "stud" game whereby the player gets to throw the dice once to generate a final outcome. This can also be played as a "draw" game whereby the player can optionally elect to re-roll one or more dice to improve his outcome as occurs in an equivalent draw poker game.

For example, for a stud game, the following pay table could be offered whereby the player would receive the listed award multiplier for any of the listed outcomes relative to his wager:

| OUTCOME | AWARD |
|---|---|
| 5 of a kind | 50-1 |
| 4 of a kind | 10-1 |
| full house | 5-1 |
| 3 of a kind | 2-1 |
| 2 pair | 1-1 |

For any other outcome, the player loses his wager.

There are a number of wagering games whereby the player has the ability to wager on different types of results for the same outcome. A good example of this is ball-style wagering games in the United Kingdom such as "Balls" on www.ladbrokes.com, "Lucky Square" on www.bluesq.com or "Rolling Stones" on www.stanleyinstants.com whereby players wager on outcomes of six drawn numbers which also have a color or shape associated with each number. The wager opportunities include predictions regarding the color/shape as well as outcomes involving the numbers, the sum of numbers, the pattern of numbers, etc.

The term "skill" has many possible connotations in wagering games. For the purposes herein, the following definitions apply:

Strategic Skill Game: A game where the player makes decisions that affect his or her ability to win. Examples include blackjack and video poker.

Physical Skill Game (a/k/a a Twitch Game): A game where some physical skill, like timing a button press, affects the outcome. Amusement slot machines in Florida have skill stop buttons for each reel to overcome any reel weighting. "Skill With Prize" machines in Europe often have a true skill mechanism where a level in a bonus "thermometer" moves up and down randomly at a quick pace and stops when a player presses a button.

Pseudo-Skill Game: A game with the appearance that it may offer some level of physical control over the outcome. The dart game in Bally Gaming's Game Magic makes players think that their ability to launch and initially direct the darts can somehow affect where they land. Some "Skill With Prize" slot machines are Pseudo-Skill insofar as it may look to some players that there actions can affect the outcome when in reality they do not.

Some slot game are offered in a grid configuration such that at each grid intersection, a symbol is randomly selected and displayed and the player wins if certain orders or patterns of symbols appear along horizontal, vertical or diagonal pay line on which the player has placed a wager. An example of this is the Vacation USA™ 4×4 slot which can be seen at www.hardrockcasino.com or www.skybetvegas.com.

Many wagering games, especially those implemented via a video game component or as an Internet-based game, offer bonus rounds whereby the player is given the opportunity to earn extra rewards than those usually possible in standard play. Some such games may require an extra wager for such an opportunity, as with the game "Multi-Hand Blackjack with 1000× Bonus" on www.hardrockcasino.com or www.skybetvegas.com. One specific game may have the bonus available to all players, such as with the "Bananarama 5" reel game offered on both of the previously listed websites. Another specific game may have the bonus available to a player who has met a certain betting threshold, such as the "Plinko Bonus of The Price is Right 5" reel slot game offered on both of the previously listed Web sites.

There continues to be a need for a new method of conducting and playing wagering games premised on the use of dice.

SUMMARY

Accordingly, the embodiments of the present invention involve numerous innovations to casino dice-based game design. One such innovation is the use of a poker dice game with a novel outcome award hierarchy with special properties that are advantageous for the player. Another innovation is the use of colored die and/or dice pips which increases the number of possible outcomes.

Another innovation involves adding a pseudo-skill stop and/or a physical skill-stop component to a wagering dice game.

Another innovation is the incorporation of additional wagering opportunities which can likewise include the use of colored dices and/or colored dice pips.

Another innovation is to offer the use of multiple wagering opportunities of the same kind in the same game, for example, offering multiple simultaneous n-dice games via an n×n grid of dice.

Another innovation is to offer the use of multiple wagering opportunities of the same kind in the same game where not all of the groups of dice are the same size. This can include a super group comprising some or all of the smaller groups.

Another innovation is the incorporation of a bonus round. Each innovation is described in detail below.

An innovative pay table can be offered in a five-dice poker dice game whereby the player always has an opportunity to receive some award after four of the five dice values have been revealed. This can maintain the player's excitement and interest until the final die value is revealed. This also better accommodates players who want to root for or try to evoke a certain outcome. A player may find it easier, or believe it is more effective, to root for a specific value on one die than for five dice.

Below is one example of such a pay table:

| OUTCOME | AWARD |
|---|---|
| 5 of a kind | 50-1 |
| 4 of a kind | 10-1 |
| full house | 5-1 |
| 3 of a kind | 2-1 |
| 2 pair | ½ |
| 1 pair | 0 |
| Straight | 2-1 |
| Otherwise | 1-1 |

The award column lists the award multiplier used to form a player award relative to a player wager. An award value of 1 means the bet is returned and a value of ½ means half of the bet is returned.

Another innovation involves the use of distinctly colored dice and/or color dice pips. In a poker dice game, with dice of two or more distinct colors, outcomes such as a flush (all dice the same color) or straight flush (a straight whereby all dice are of the same color) can be part of the pay table. In addition to adding to the volatility of a given poker dice game, it can also make the game more interesting to people familiar with card poker games.

For a video-game or Internet-based application, the selection of dice color for display is quite easy to implement. In a live environment, dice of distinct colors can be placed in an urn, tumbler or shaker and the required number of dice can then be drawn from the pool of dice.

One can also envision a hybrid game whereby standard physical dice are used, but a secondary device is used to select the colors. For example, a computer or similar device may select colors and these colors are then displayed on or near the dice using colored lights or colored LED displays, etc.

A poker dice game with multiple dice colors can be defined whereby there is an equal chance of obtaining any specific die color, similar to the equal chance of obtaining any specific card suit by randomly drawing a single card from a standard deck of playing cards. However, the use of colored die can be applied to games without an even distribution of color and/or not based on a five dice poker dice concept.

For example, the pay table below describes the award structure for a three dice game consisting of dice with four distinct colors, where the distribution of color possibilities is not even. In this example, the chance that a given die color will be red, blue, gold or green is 1/11, 3/11, 3/11 and 4/11, respectively, such that a green die color is much more likely to appear than a red die color for any given die.

| COLOR OUTCOME | PIP OUTCOME | AWARD |
|---|---|---|
| all red | 3 of a kind | 1,000-1 |
| all blue | 3 of a kind | 100-1 |
| all gold | 3 of a kind | 50-1 |
| all green | 3 of a kind | 25-1 |
| Multicolor | 3 of a kind | 10-1 |
| all same color | straight | 10-1 |
| all same color | pair | 5-1 |
| all same color | otherwise | 2-1 |
| Multicolor | straight | 2-1 |
| Multicolor | pair | 1-1 |

For this pay table, any outcome that does not correspond to one of the listed outcomes produces no award. The uneven dice color distribution allows the pay table to offer larger awards for certain color combinations which are not be possible if the color distribution is even without adversely affecting the potential profit for the casino or game operator.

Another innovation is the use of pseudo-skill stop in a dice-based wagering game. In a game with one or more electro-mechanical dice, the player can be given the ability to attempt to stop a given die while it is spinning thereby giving some players the impression that they may be able to control the actual outcome based on when they activate the stop button. This of course can be done easily in a video-based or Internet-based implementation. With a game involving dice with different colors or different pip colors, it is quite easy to display on a video display screen or Internet browser display the animation of a moving die where the color changing can be visually discerned even if the dice values are flashing too quickly to be easily viewed.

Another innovation is the use of physical-skill stop in a dice-based wagering game. In a game with one or more electro-mechanical dice, the player can be given the ability to attempt to stop a given die while it is spinning whereby the actual outcome is affected by the time at which the player activates the stop button. This of course can be done easily in a video-based or Internet-based implementation. With a game involving dice with different colors or different pip colors, it is quite easy to display on a video display screen or Internet browser display the animation of a moving die where the color changing can be visually discerned even if the dice values are flashing too quickly to be easily viewed.

Another innovation is the incorporation of additional wagering opportunities beyond typical poker dice game pip matching and pip pattern outcomes. For example, instead of having the player place a single wager corresponding to a pay table for two or more distinct outcomes, a game can be defined which allows players to wager on specific outcomes or specific groups of outcomes. For example, a game can be defined which allows the player to make separate, independent wagers on each of the following outcomes:

| OUTCOME | AWARD |
|---|---|
| 5 of a kind | 1,200-1 |
| 4 of a kind | 50-1 |
| full house | 25-1 |
| 3 of a kind | 6-1 |
| 2 pair | 4-1 |
| 1 pair | 2-1 |
| Otherwise | 10-1 |

Alternatively, or additionally, different kinds of wagers can be placed on the pip values. Examples include but are not limited to:

the sum of the values falls within some certain range (e.g., 5-8, 9-15, 16-20, 21-25, 26-30, where the player wagers on a specific range);

the sum of the values is odd;

the sum of the values is even;

the values are all increasing (e.g. 1,2,3,4,5 or 1,2,4,5,6);

the values are all decreasing;

the values are all ascending or flat (e.g. 1,1,2,3,3, or 1,2,4, 5,6); and/or the values are all descending or flat.

Alternatively, or additionally, different kinds of wagers can be placed on specific pip values. Examples include but are not limited to:

a specific die value occurs k or more times;

a specific die value occurs exactly k times;

a specific die value does not occur; and/or a specific die value occurs in a specific outcome location Some more specific examples of the above include:

pay award that the chosen dice value will occur exactly as a pair;

pay award that the chosen die value will occur as a pair or better (e.g., three of a kind, four of a kind, five of a kind); and/or variable pay award that the chosen die value will occur as a pair or better (e.g., three of a kind, four of a kind, five of a kind), whereby the better the outcome, the higher the pay award.

Alternatively, or additionally, different kinds of wagers can be placed on specific outcomes. For example, a player can place separate side bets that a specific outcome, such as a pair or a three of a kind, will occur. These propositions can be offered such that the award for such a successful prediction corresponds to the probability of the occurrence.

Alternatively, or additionally, a secondary characteristic can be assigned to each die, such as color as mentioned above. This allows for independent wagers such as, but not limited to, the following examples:

Exactly 0 dice of color A;

Exactly 1 die of color A; and/or

Exactly 2 dice of color A.

. . .

Exactly k dice of color A;

All dice of color A;

1 or more dice of color A; and/or 2 or more dice of color A.

. . .

k or more of color A;

At least 1 of each color;

At least 2 of each color;

All of the dice have the same, unspecified color; and/or

The dice colors are only in a certain order (e.g., 1 or more reds, then 1 or more whites, then 1 or more blues)

The use of these kinds of additional wagering opportunities is expected to appeal to players who believe they can spot patterns and who believe they may be able to capitalize on such things or to appeal to players who like a variety of wagers and ways to win in the same game.

Another innovation is to offer the use of multiple wagering opportunities of the same kind in the same game. For example, instead of offering a game based upon the outcome of three dice, a game can be designed to contain an arrangement of multiple sets of three dice for multiple simultaneous games, each of which accommodates separate wagers. In such games, the dice can be independent, such as having three rows of three dice thus offering three simultaneous games in one play. Alternatively, or additionally, such a game can involve interdependent dice whereby at least one die is used in two or more different outcomes. For example, nine dice can be configured in a 3×3 grid or matrix allowing for game outcomes to be determined along the three horizontal rows and the three vertical columns as well. This can also be extended to include the diagonals of the grid. The concept can include other grid sizes, such as a 5×5 grid that can offer five horizontal rows of five dice, five vertical columns of five dice and two diagonal rows of five dice. The concept can be extended to other patterns such as boxes or other geometric patterns, sectors of a circular pattern, with or without overlapping die, snowflake patterns, patterns to match a specific graphic or theme, etc.

Another innovation is to offer multiple wagering opportunities of the same kind in the same game where not all of the dice groups include the same number of dice. For example, a 3×5 grid of dice can offer three groups of five dice and five groups of three dice, or eight different outcomes. Alternatively, or additionally, a group can also be defined to include some or all smaller groups. For example, a 3×5 grid of dice can offer three groups of five dice plus a super group of all fifteen dice.

Another innovation is the incorporation of a bonus round into a dice-based casino game. One simple way to accomplish this is to use a separate random or pseudo-random process to determine, after all player wagers have been placed, whether a given round is a bonus round. Examples of such processes include, but are not limited to, a separate shaker of dice, specific outcomes of which can trigger a bonus, a deck of cards or other indicia from which an item is drawn to determine the current round is a bonus round, an electrical, electromechanical or mechanical device which randomly indicates when a bonus round is to be activated, for a video-based or Internet-based game, a computer program which randomly or pseudo-randomly decides when a bonus round should occur.

Bonus rounds can also be triggered using some of the standard game outcomes. For example, in a five dice game, a four of a kind or better can trigger a bonus round. A bonus round might also be triggered based upon certain colors, or certain combinations or patterns of colors, etc. For example, a game might normally feature only white dice but one or more of the dice might be a bonus color. A bonus can occur whenever such a colored die occurs in an outcome. Alternatively, a different kind of game can require that the player needs to obtain a winning outcome using the colored die in order to trigger a bonus. A similar example is a dice game whereby the appearance of a certain colored die can increase the size of any standard award that occurs in that outcome. A different kind of game can trigger a bonus round when all of the dice are of the same color. Yet another example might be when a different kind of color or shape pattern occurs in an outcome. For dice using the grid innovation described above, a bonus can be offered based upon outcomes that span a number of pay lines. For example, in a 3×3 grid game, a bonus can be triggered if there is a winner on all pay lines, or if there is a certain number of matching die values across the nine die, or if there is a certain number of matching colors across the matching die, or if certain values and or colors occur within a certain pattern, such as the corners or the periphery of the grid.

There are a myriad of bonus features once a bonus is triggered, including but not limited to free plays, award multipliers, secondary games, etc. One such secondary game can involve playing a game similar to Yahtzee®.

Other variations, embodiments and features of the present invention will become evident from the following detailed description, drawings and claims.

DETAILED DESCRIPTION

Figure 1:
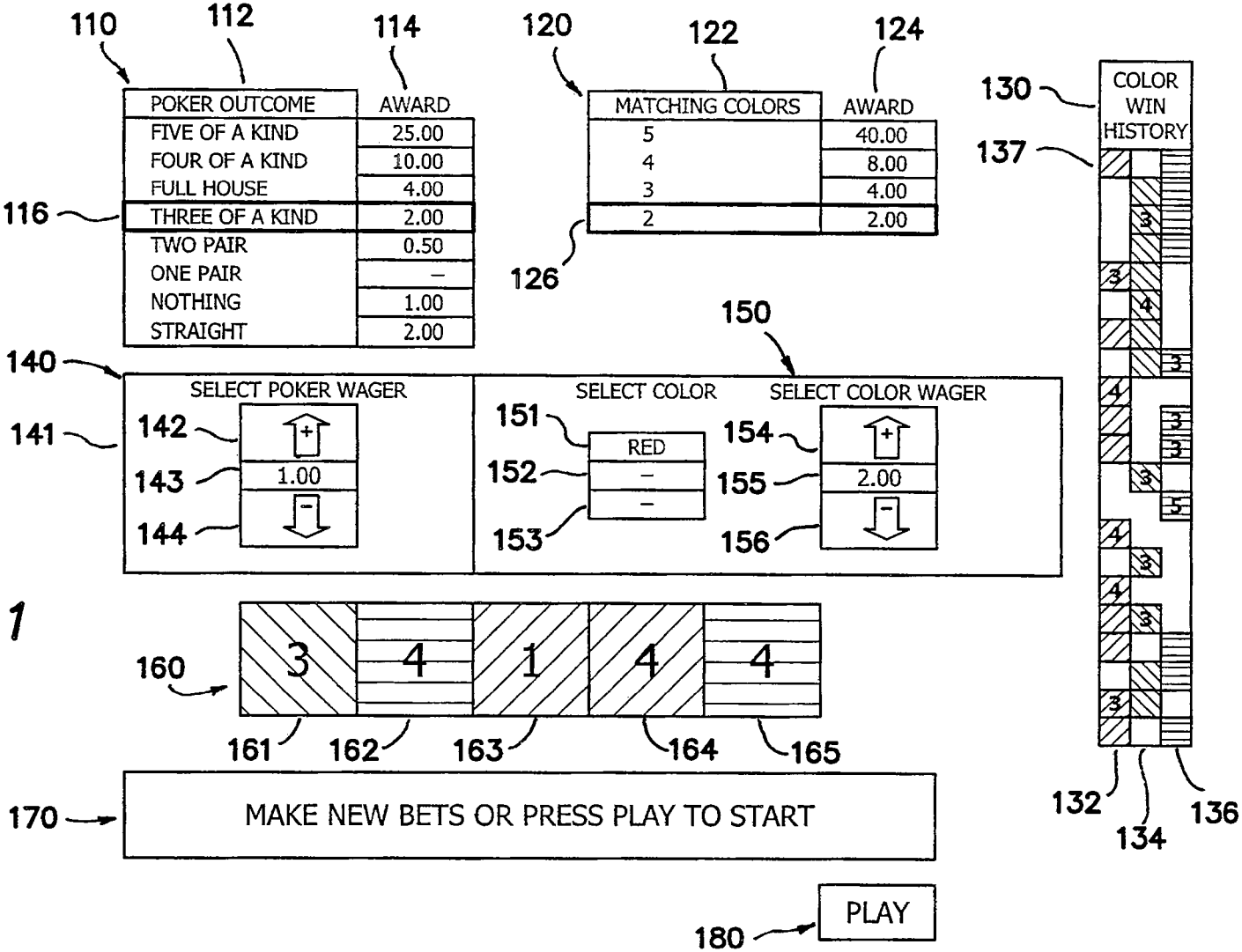
FIG. 1 shows a first embodiment game screen.

For the purposes of promoting an understanding of the principles in accordance with the embodiments of the present invention, reference will now be made to the embodiments illustrated in the drawings and specific language will be used to describe the same. It will nevertheless be understood that no limitation of the scope of the invention is thereby intended. Any alterations and further modifications of the inventive feature illustrated herein, and any additional applications of the principles of the invention as illustrated herein, which would normally occur to one skilled in the relevant art and having possession of this disclosure, are to be considered within the scope of the invention claimed.

The embodiments of the present invention are ideal for video-based and Internet-based applications. Therefore, the following description focuses on such applications. However, it should be noted that live applications are conceivable and within the spirit and scope of the present invention.

Turning to the drawings, FIG. 1 shows a first embodiment of the present invention in the form of a game which incorporates a number of the innovations mentioned above. A display 100 of a video-based gaming device or Internet-based application facilitates play of the first embodiment of the present invention. The first embodiment game offers two types of outcomes to wager on, namely poker outcomes 112 listed in poker outcome table 110 and color outcomes 122 listed color outcome table 120. The poker outcome table 110 and color table outcome 120 also include award amounts 114, 124. As shown, the "Three of a Kind" outcome 116 is highlighted indicating the poker outcome from the prior game. The color outcome table 120 comprises a column of color match numbers 122 and the corresponding award amount 124. As shown, the two match color outcome 126 is highlighted to indicate the color outcome from the prior game. The game outcome 160 comprises dice values and dice colors of the five game dice 161-165. A user interface 140 comprises a poker wager interface 141 and color wager interface 150 for viewing and modifying the poker outcome wager and the color outcome wager, respectively. The poker wager user interface 141 displays the current poker wager amount 143 and includes arrows 142, 144 which allow the player to increase or decrease the wager amount. Similarly, the color wager user interface 150 displays the current color wager amount 155 and includes arrows 154, 156 which allow the player to increase or decrease the wager amount. The selected color 151 is displayed and can be changed using color selectors 152 or 153.

A text area 170 for displaying instructions, results or marketing messages to the player and a play icon 180 are also prominent on the display 100. A game board 130 records a history of color outcomes 122 and comprises a red column 132, yellow column 134 and green column 136. If a given board square is colored, then the corresponding outcome included at least a color match of two. If a given square is colored and includes a numeral therein, the numeral represents the exact number of matches. A top row 137 of the history board represents the most recent game outcome 160 as defined by the dice 161-165. As shown, the top row 137 displays a red colored square with no numeral therein and a green colored square with no numeral therein indicating that the game outcome comprised two red dice and two green dice.

Figure 2:
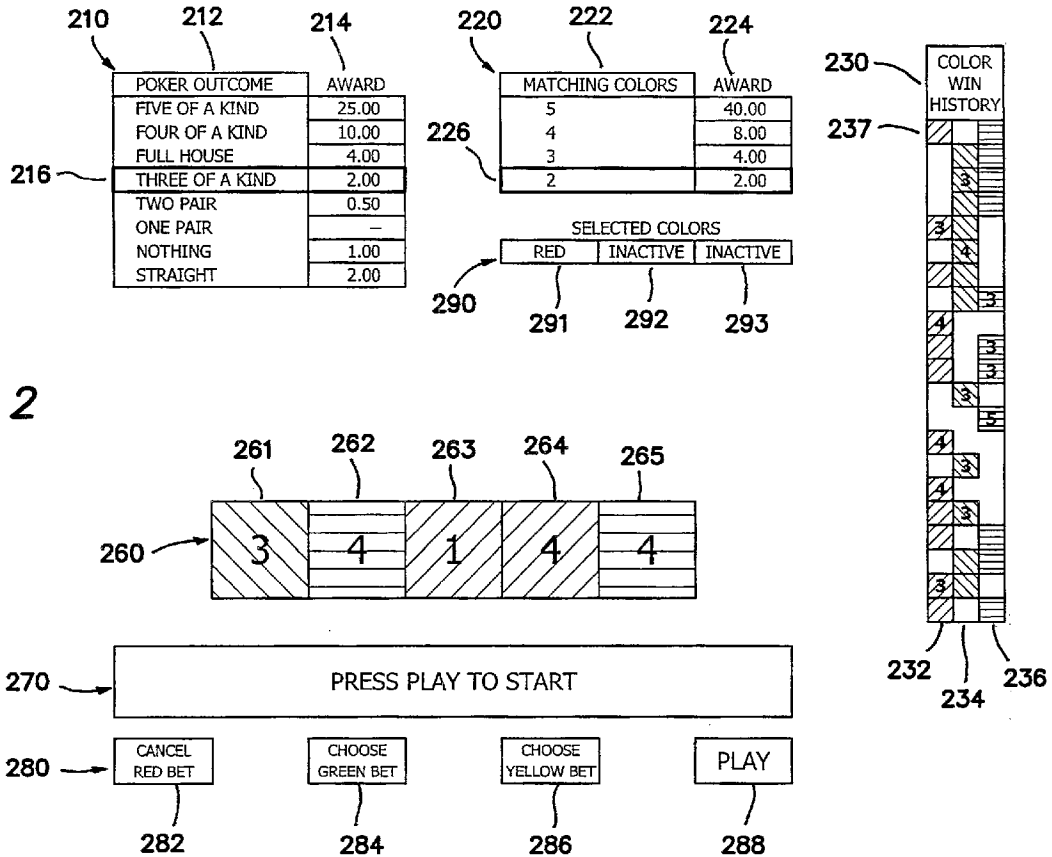
FIG. 2 shows a second embodiment screen.

FIG. 2 shows a similar game example as that shown in FIG. 1 with a modified betting structure. The game is based on a fixed betting amount (e.g., $1 or £2). Thus, when the game is played, a wager is required for the poker outcome and an optional wager can be placed on any of the colors via a color wager area 280 comprising color wager control icons 282-286. A color wager tracking area 290 records which, if any, colors have been wagered on.

Figure 3:
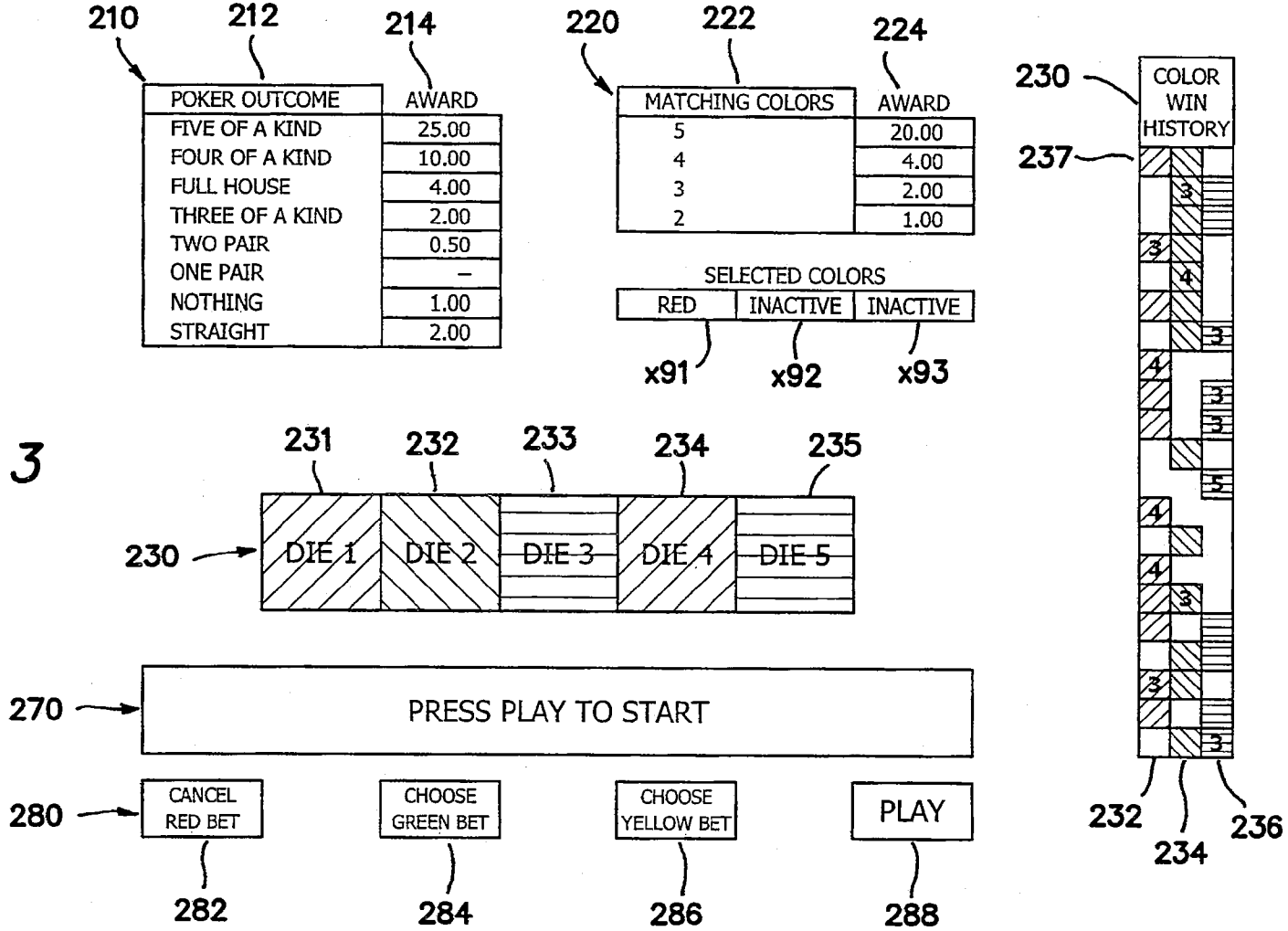
FIGS. 3-10 show a sample play of the second embodiment as displayed in FIG. 2.
Figure 4:
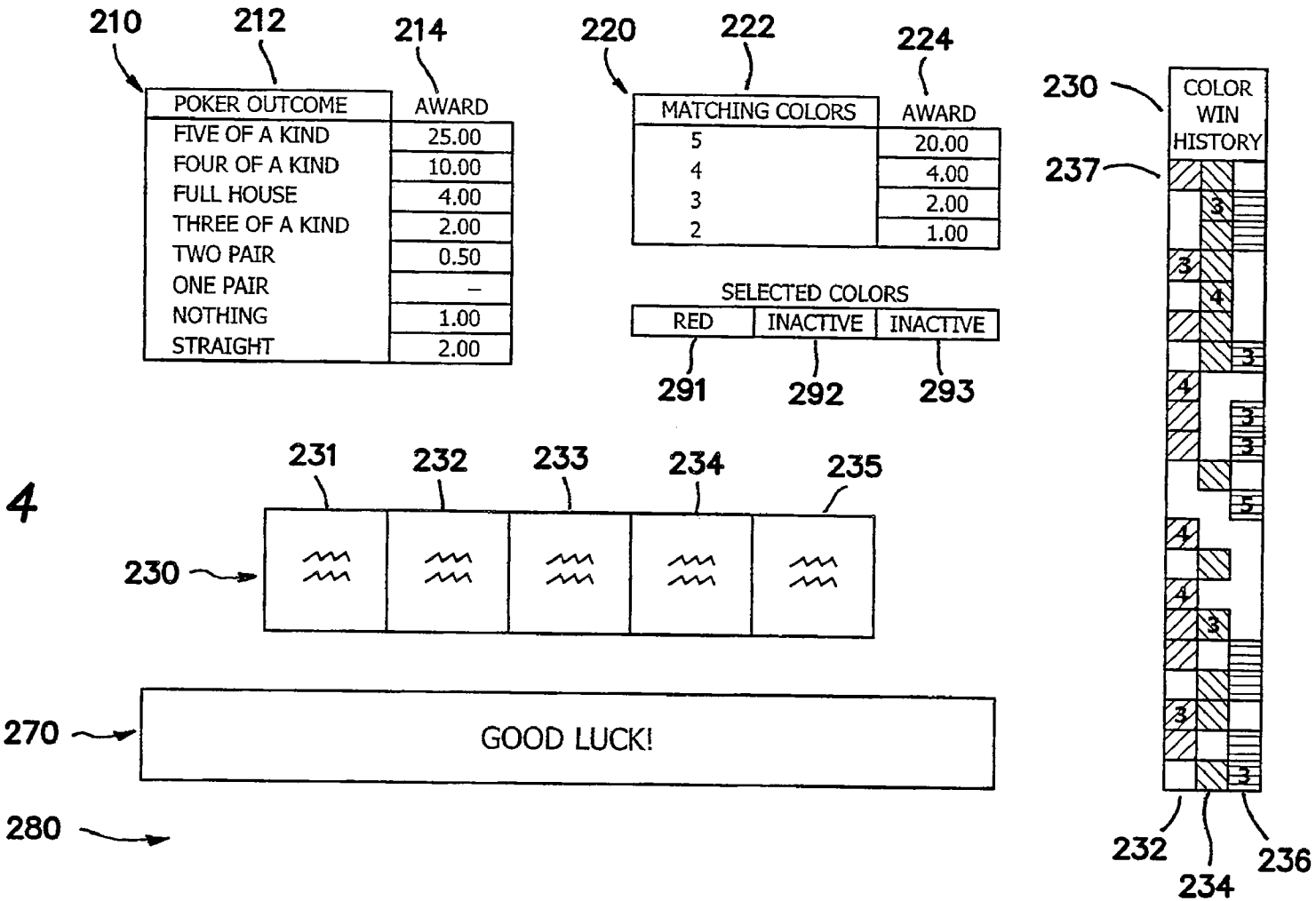
Figure 5:
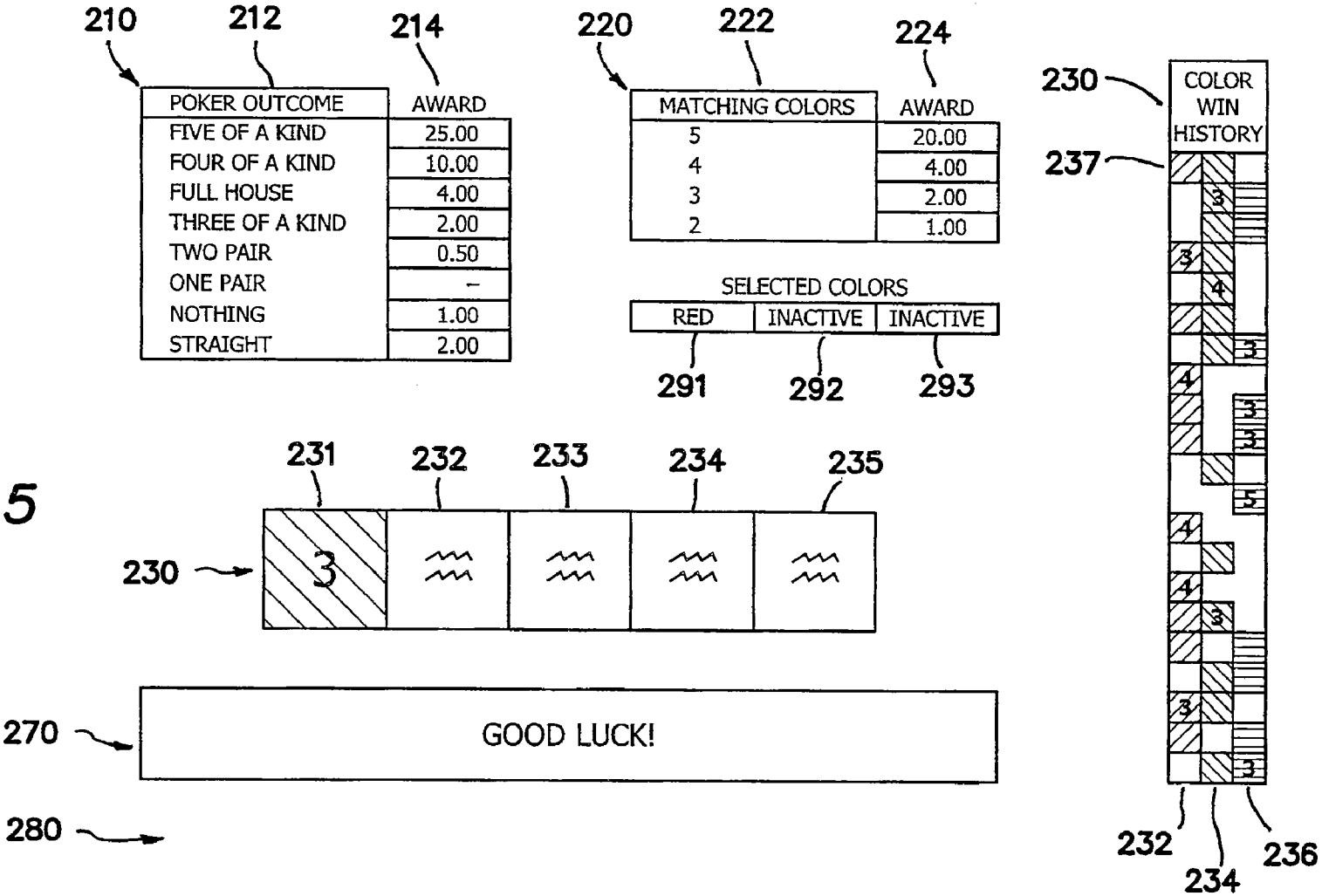
Figure 6:
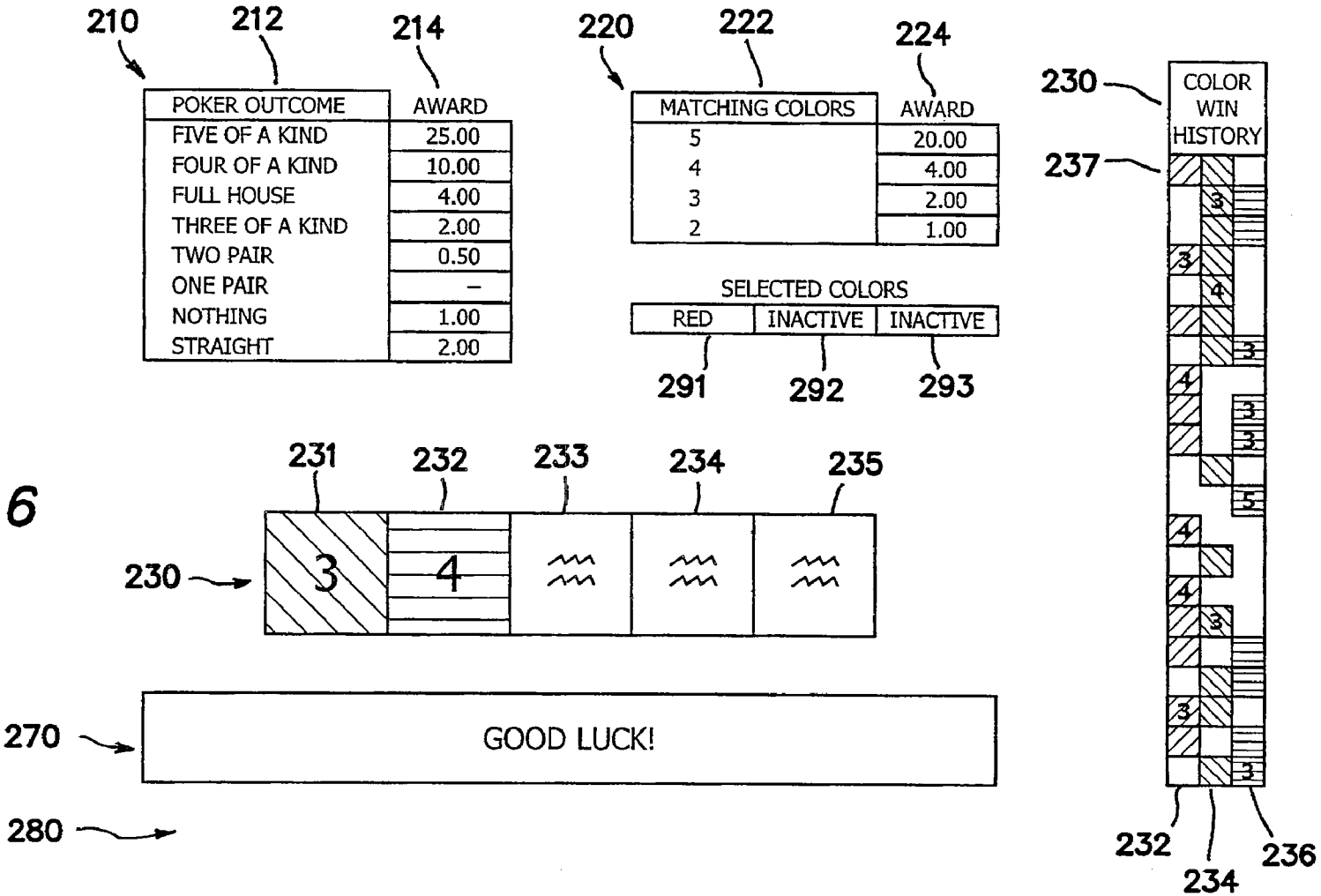
Figure 7:
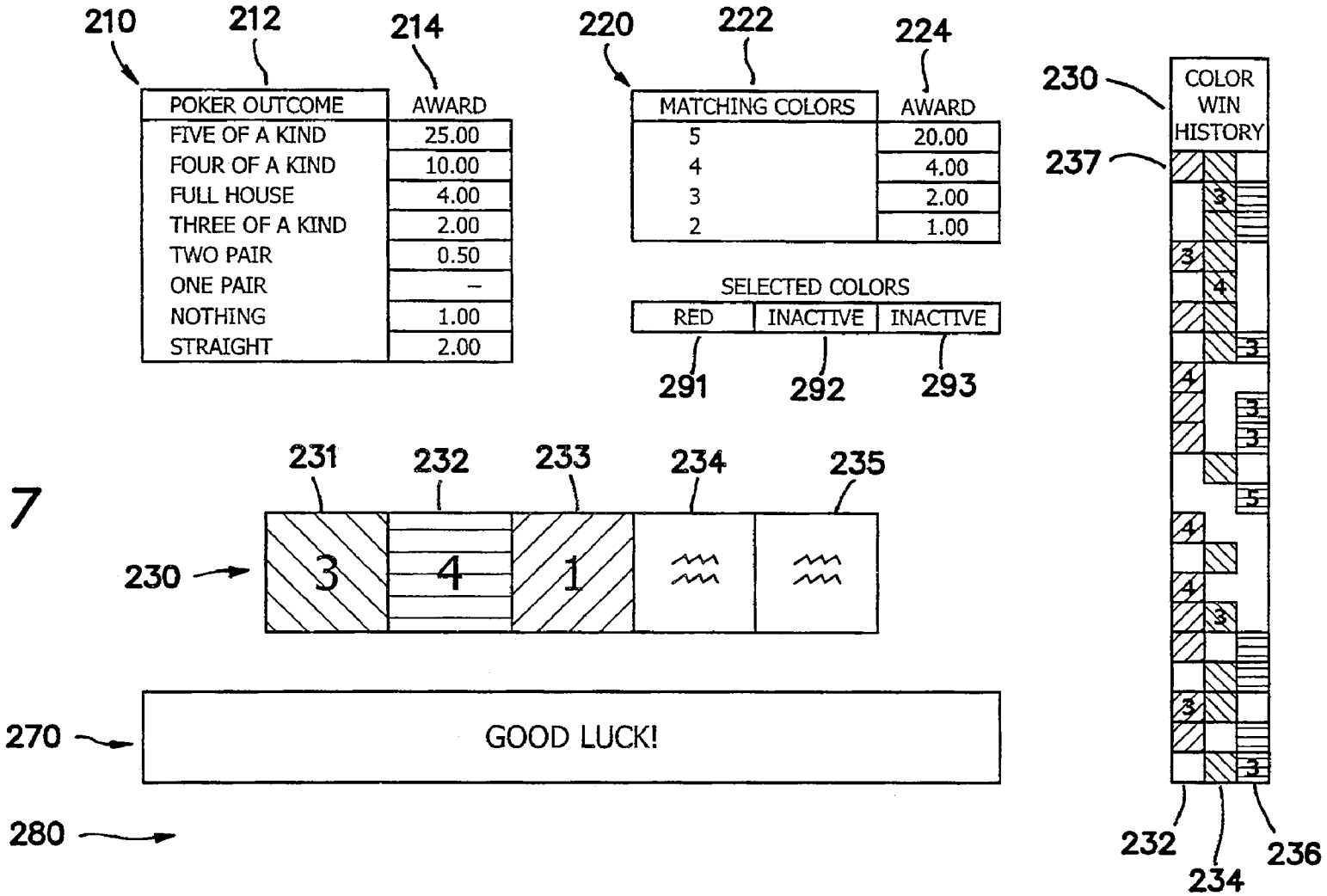
Figure 8:
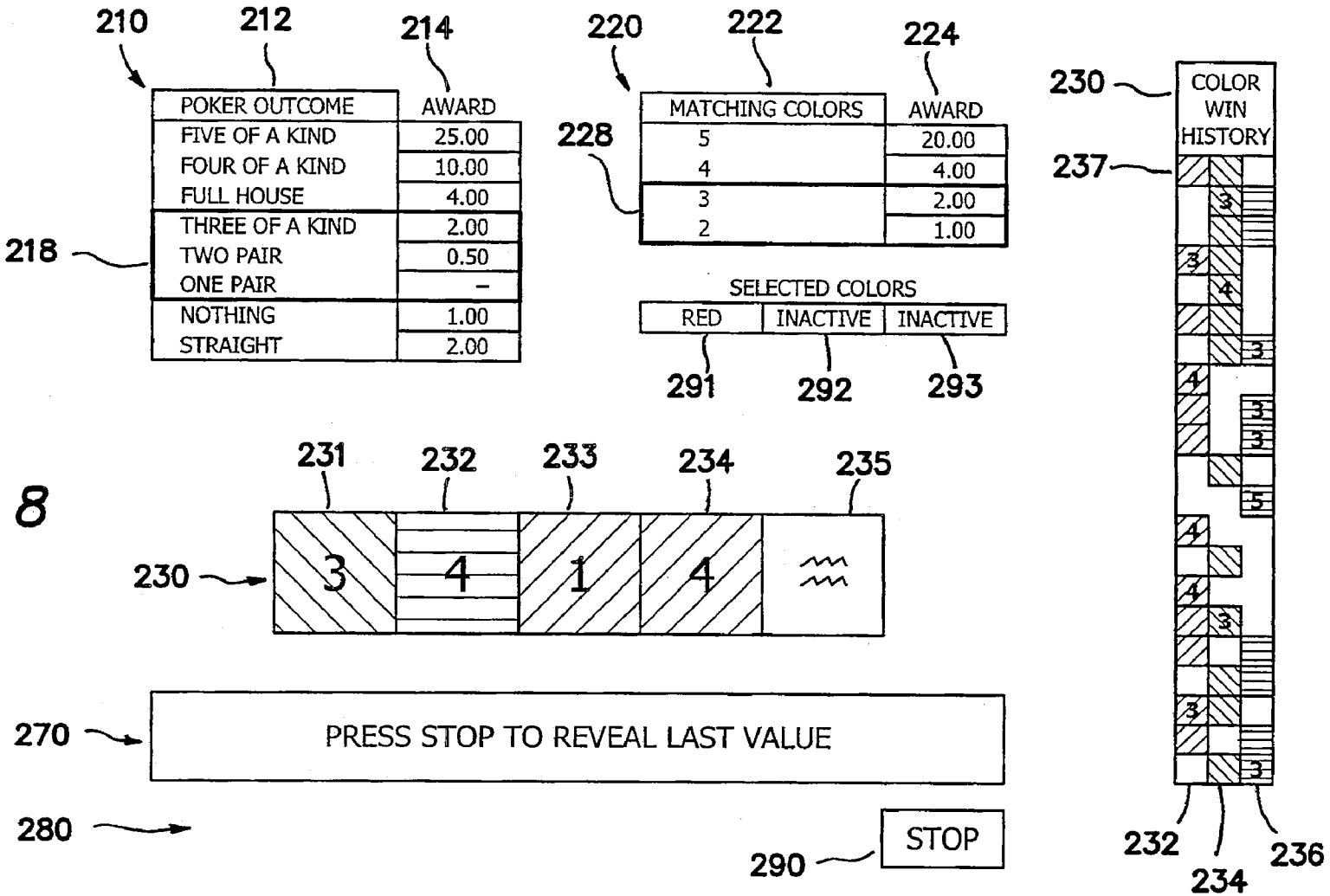

FIGS. 3 through 10 show a sample play of the game shown in FIG. 2. FIG. 3 displays the initial state of the game at which time the player may select which color bets 282-286, if any, to place. FIG. 4 represents the dice in motion. In a live game, the dice may be rolled in a tumbler or with in a shaker. As shown, the dice pips or numbers are concealed to simulate the appearance of the dice being rolled. Optionally, during the roll, the first color wager area 280 and corresponding color wager icons 282-286 are removed as unnecessary. FIGS. 5-7 show the revelation of each of the first three dice 261-263. FIG. 8 shows the display of the fourth die 264 and corresponding display changes. First, in response to the fourth die 264 being revealed, the conceivable poker outcomes 212 listed in poker outcome table 210 are highlighted 218. The poker outcome table 210 is designed such that there is always at least one possible award outcome conceivable after the first four dice values have been revealed. Such revelation creates player excitement and rooting for a final specific die value. Similarly, in response to the fourth die 264 being revealed, the conceivable color outcomes 222 listed in the color outcome table 220 are also highlighted 228. Unlike the poker outcomes 212, there is no requirement that at least one color outcome be conceivable after the first four dice are revealed. Also, in response to the fourth die 264 being revealed, a stop button or icon 288 is displayed. The stop button 288 allows the player the option of causing the fifth die 265 to stop such that a corresponding die value is revealed. The stop button 288 may be a skill or pseudo-skill stop. Whether the stop button 288 is based on skill or pseudo-skill should not be readily discernable to the player.

Figure 9:
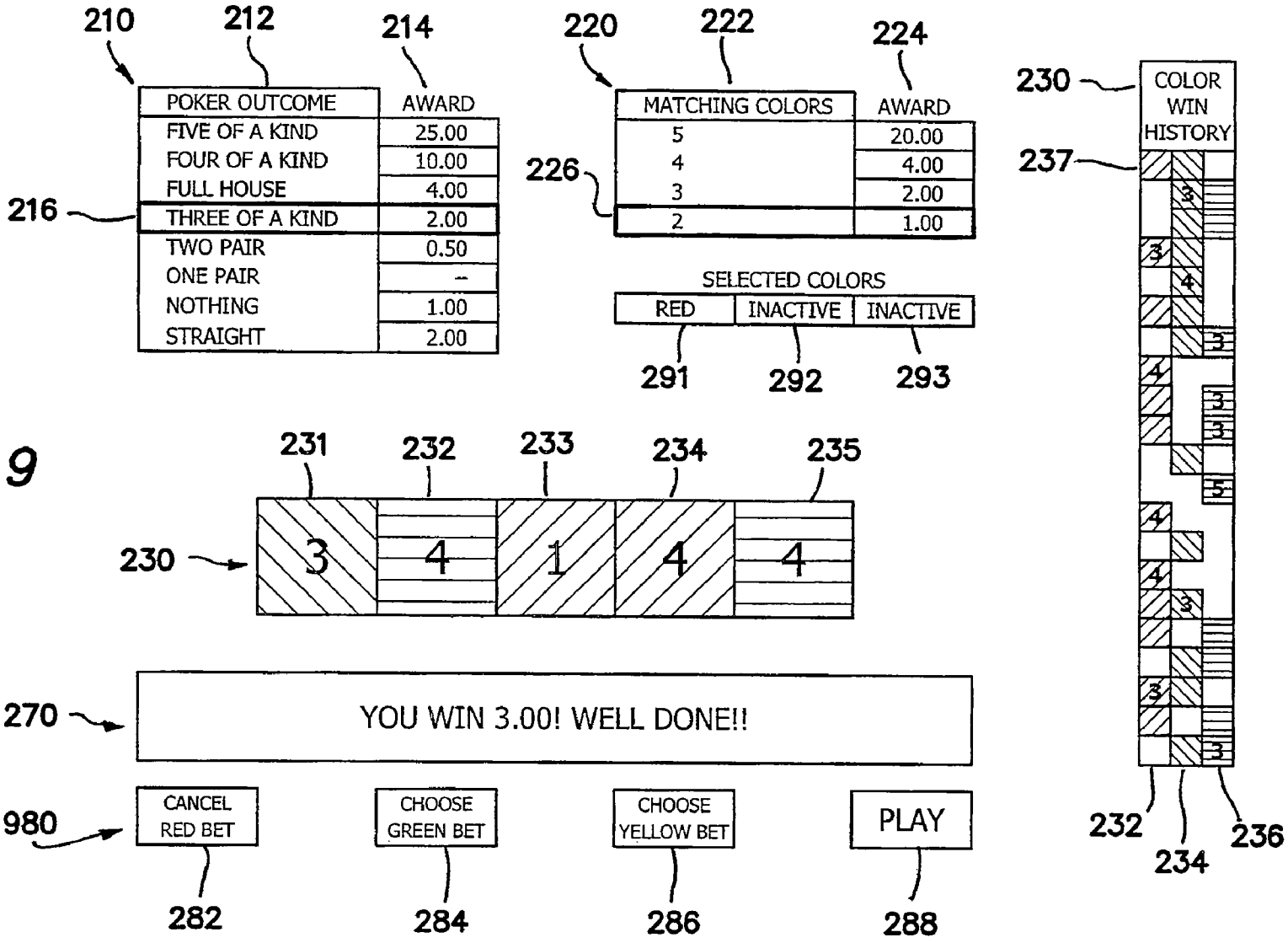
Figure 10:
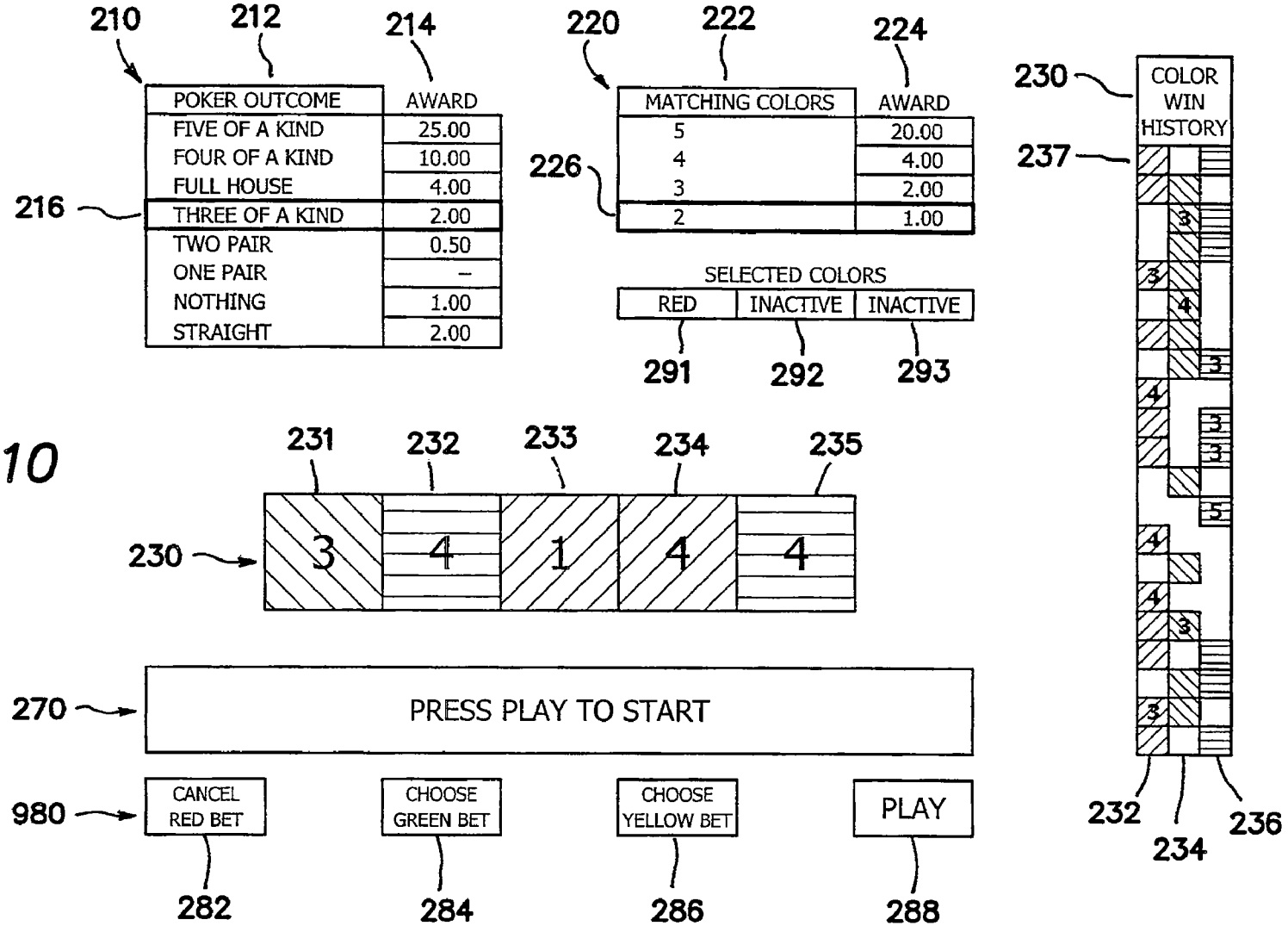

FIG. 9 shows the display 100 after the fifth die 265 has been revealed and the game outcome finalized. The poker outcome pay table 210 highlights the outcome 216 which matches the actual game outcome. If the actual game outcome matches a color outcome on the color outcome table 220, the corresponding outcome 226 is also highlighted. Message area 270 displays the wager outcome. FIG. 10 shows the display 100 at a later point when a new round of play is ready. The message area 270 now instructs the player to press the play button or icon 290 to start a next game. In FIG. 10, the color history board 230 has been updated to reflect the most recent color outcome 237.

Figure 11:
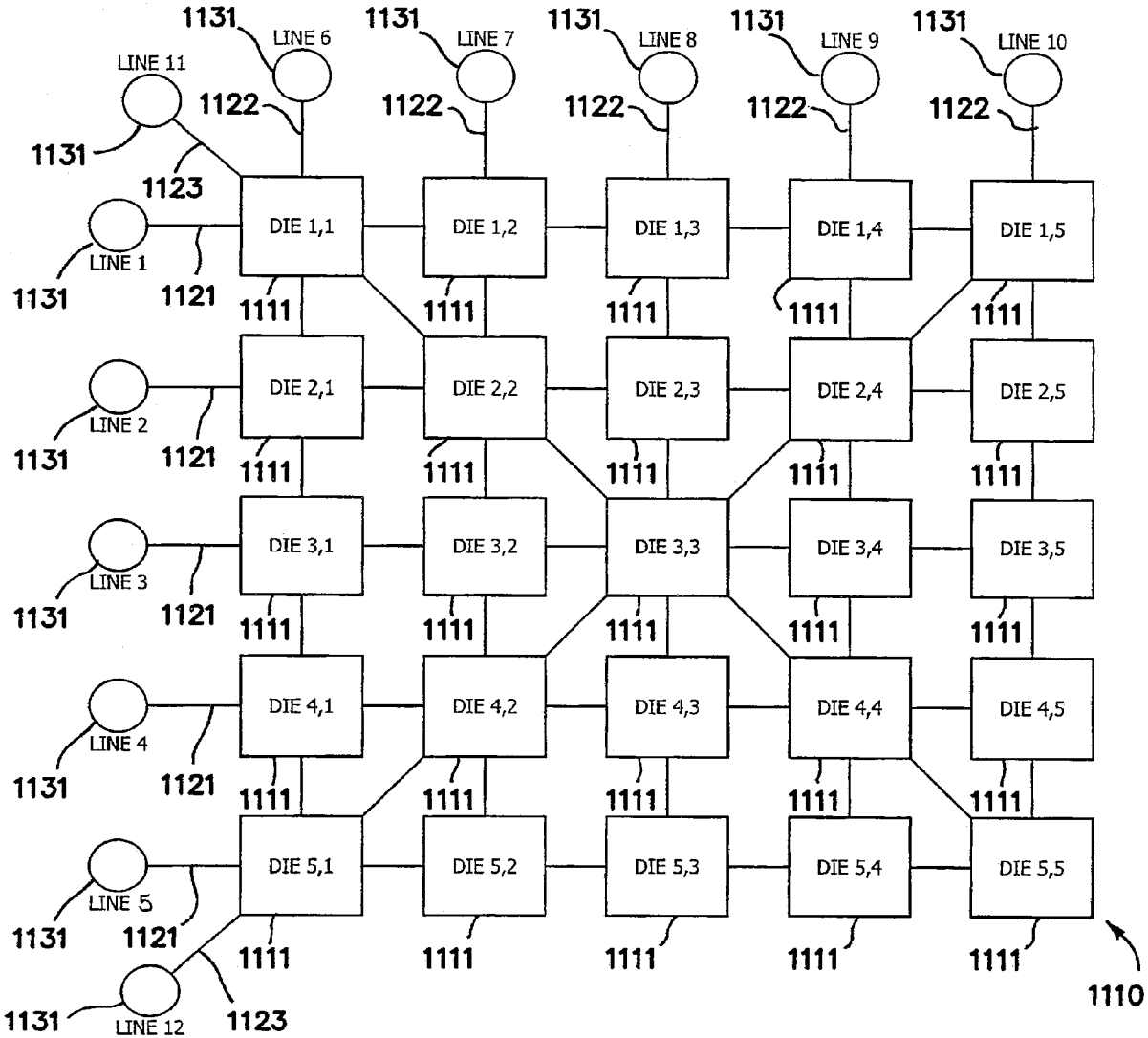
FIG. 11 shows an embodiment having a grid configuration.

FIG. 11 shows a second embodiment of the present invention comprising a grid-based game having a set of dice 1110 arranged into five rows and five columns. As shown, the configuration supports five horizontal groups of five dice each 1121, five vertical groups of five dice each 1122 and two diagonal groups of five dice each 1123. The circles 1131 adjacent to each pay line 1121-1123 are locations for the player to wager on a corresponding pay line and/or to indicate to the player how much has been wagered on a given pay line 1121-1123. In the example of FIG. 11, any given die 1111 belongs to two or more groups of die. This arrangement facilitates a game including distinct outcomes along distinct pay lines 1121-1123 as part of the same game.

Figure 12:
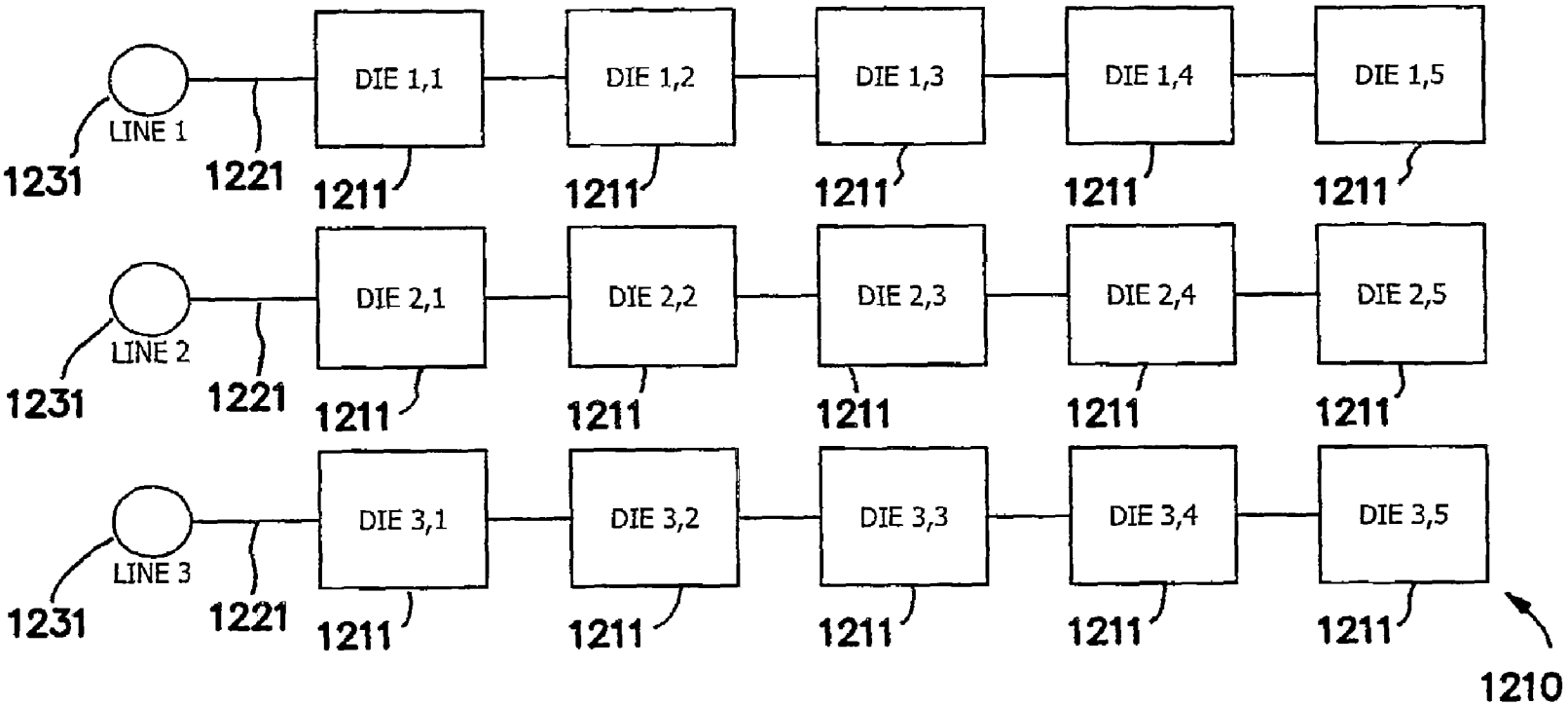
FIG. 12 shows an alternative embodiment having a grid configuration.

FIG. 12 shows an alternative grid-based game having a set of dice 1210 arranged into three rows and five columns. In this example, the configuration supports three horizontal groups of five dice 1221 and any given die 1211 belongs only to one group of die.

Figure 13:
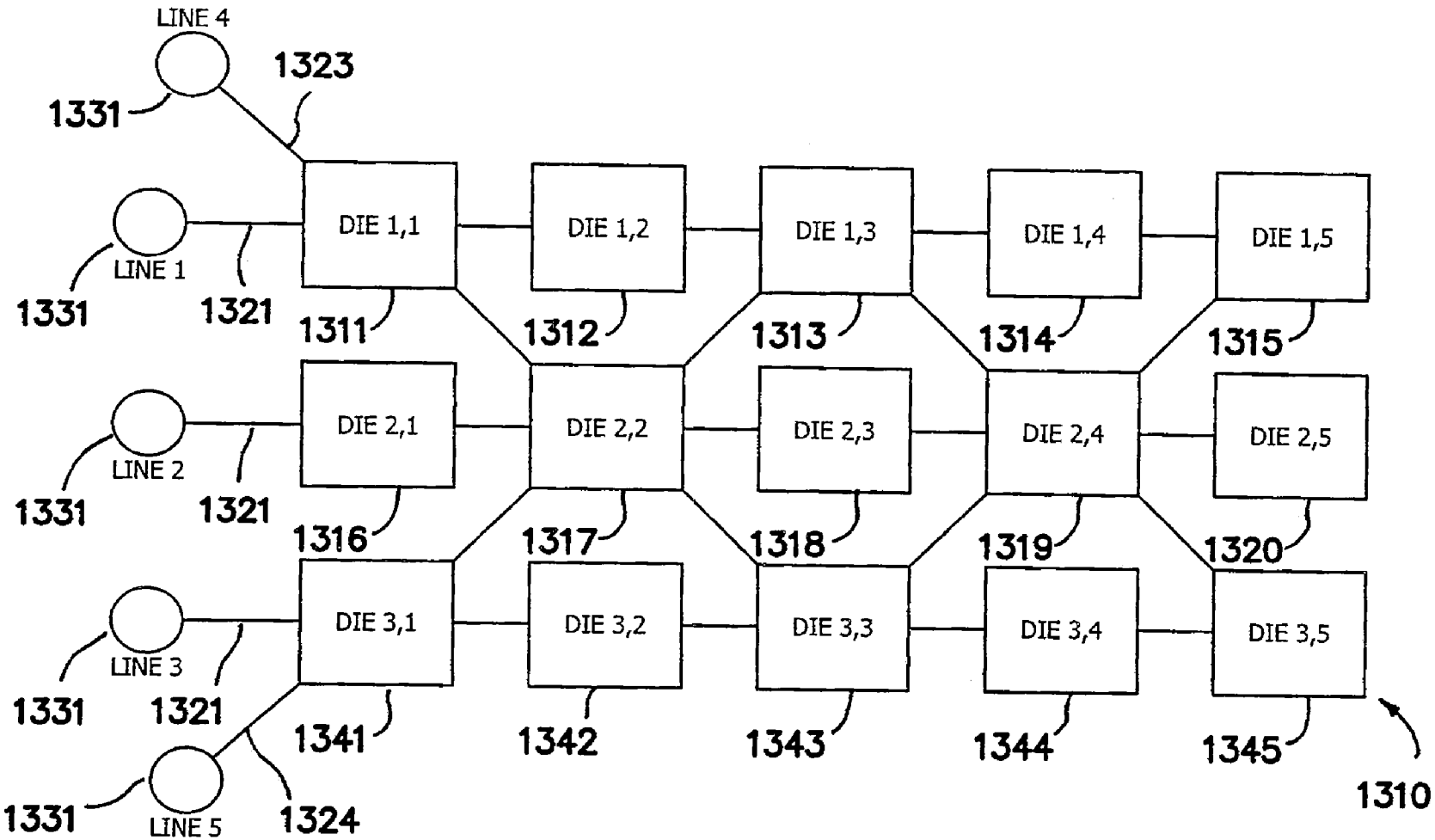
FIG. 13 shows the grid of FIG. 12 having multiple paylines.

FIG. 13 is an extension of the game illustrated in FIG. 12 showing a game including distinct pay lines than shown in FIG. 12. In this arrangement, some dice belong to more than one group of five dice. In this configuration, the pay lines may take many forms including non-straight pay lines. For example, pay line 4 may be defined to include die 1,1 die 2,2, die 3,3, die 2,4 and die 1,5, but a different pay line configuration can be easily selected.

Figure 14:
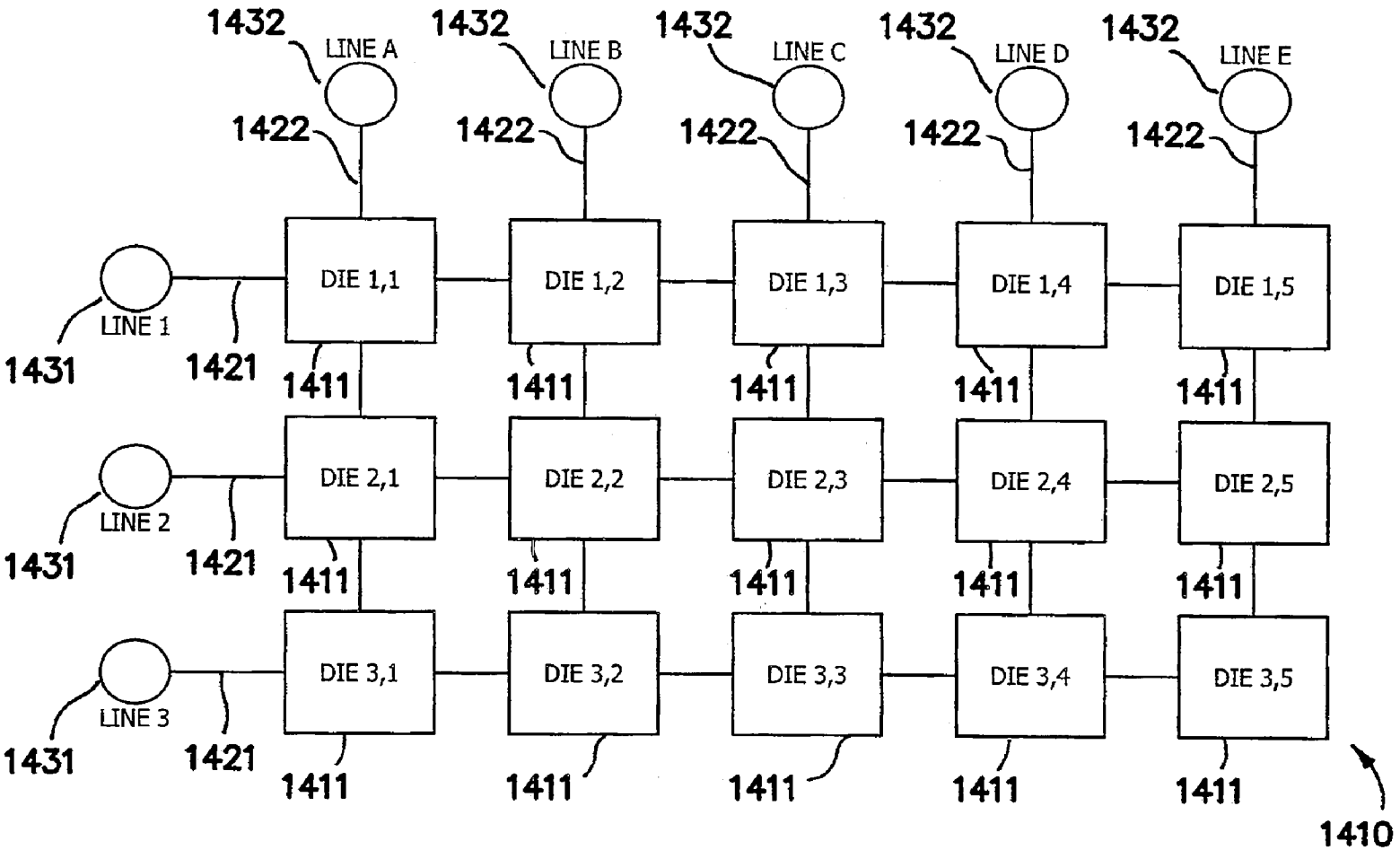
FIG. 14 shows another grid configuration.

FIG. 14 shows a game configuration combining both multiple groups of dice and different group sizes. The horizontal pay lines 1421 are groups of five dice while the vertical pay lines 1422 are groups of three dice.

Figure 15:
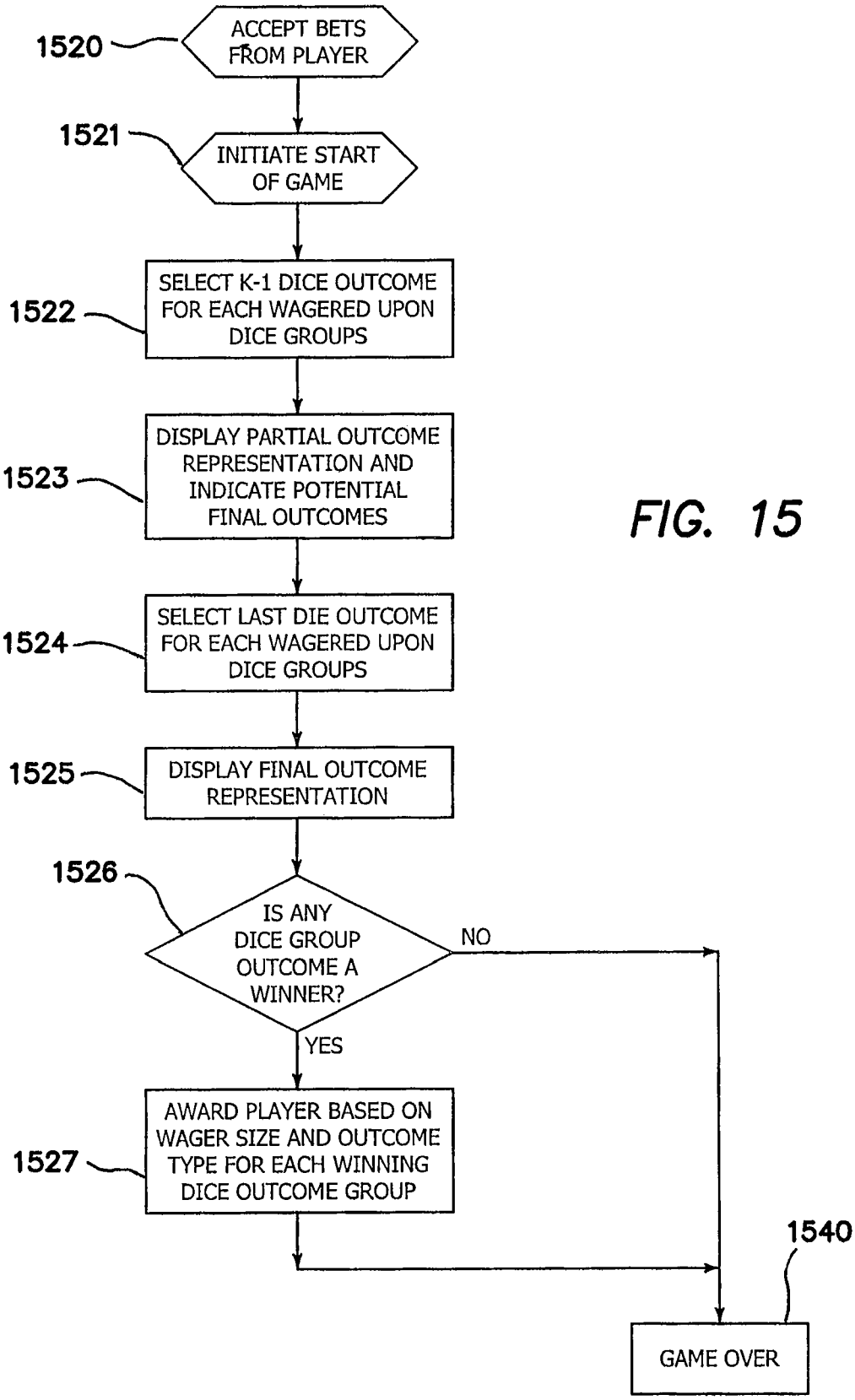
FIG. 15 shows a block diagram of a possible game implementation.

FIG. 15 shows a block diagram of one possible game implementation. After accepting bets from the player 1520 for each available group of dice the game starts 1521. All but the final die for each group wagered upon is selected 1522 and displayed 1523 along with indications of the possible final outcomes. Then, the last die of each group is selected 1524 and displayed 1525 and the final results are indicated. Each dice group outcome is examined 1526 and if any such outcome is a winning outcome then an award is given to the player 1527 based upon the outcome and the wager. Next, the game ends 1540.

Figure 16:
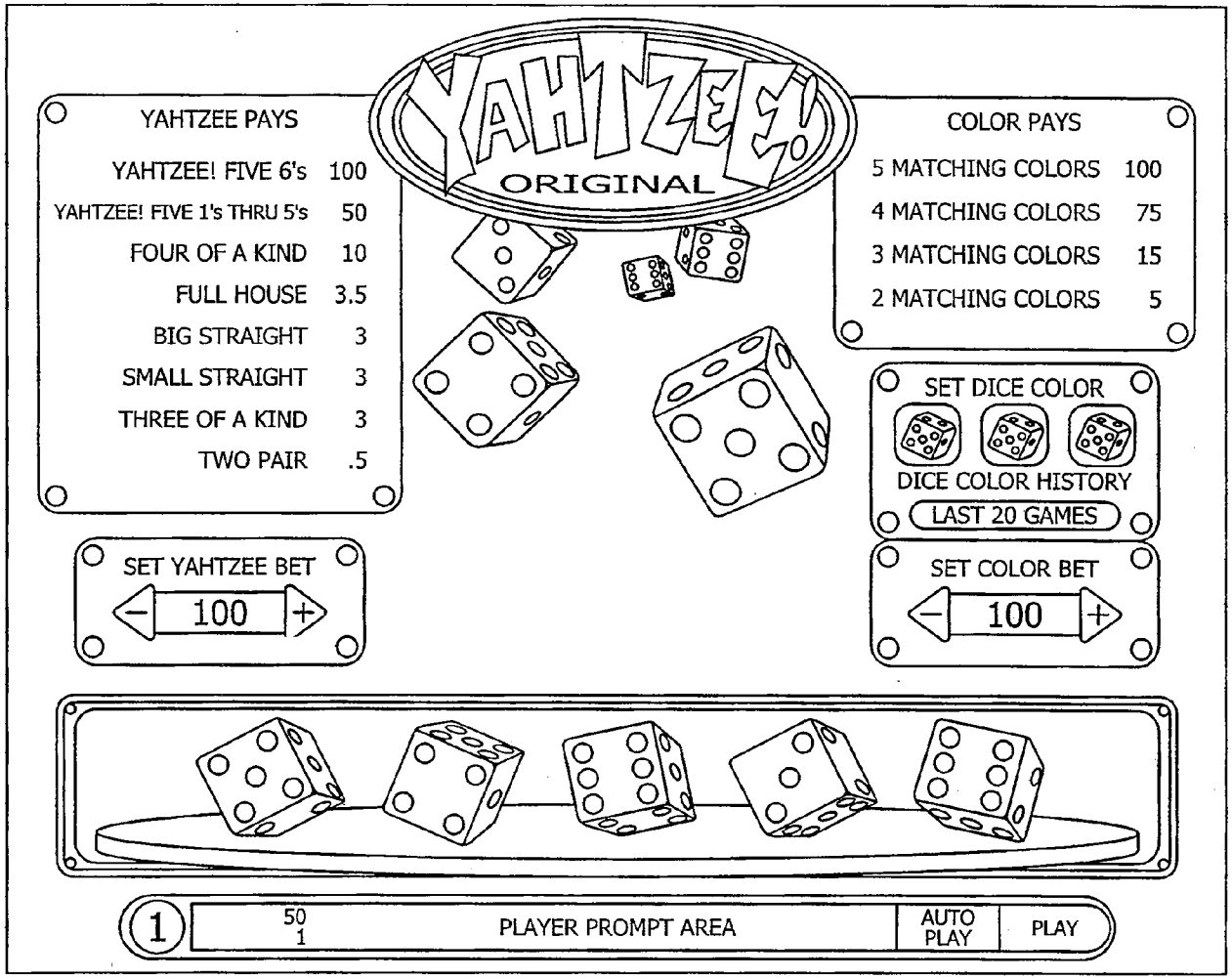
FIG. 16 shows a sample game screen-poker dice and color wager propositions.
Figure 17:
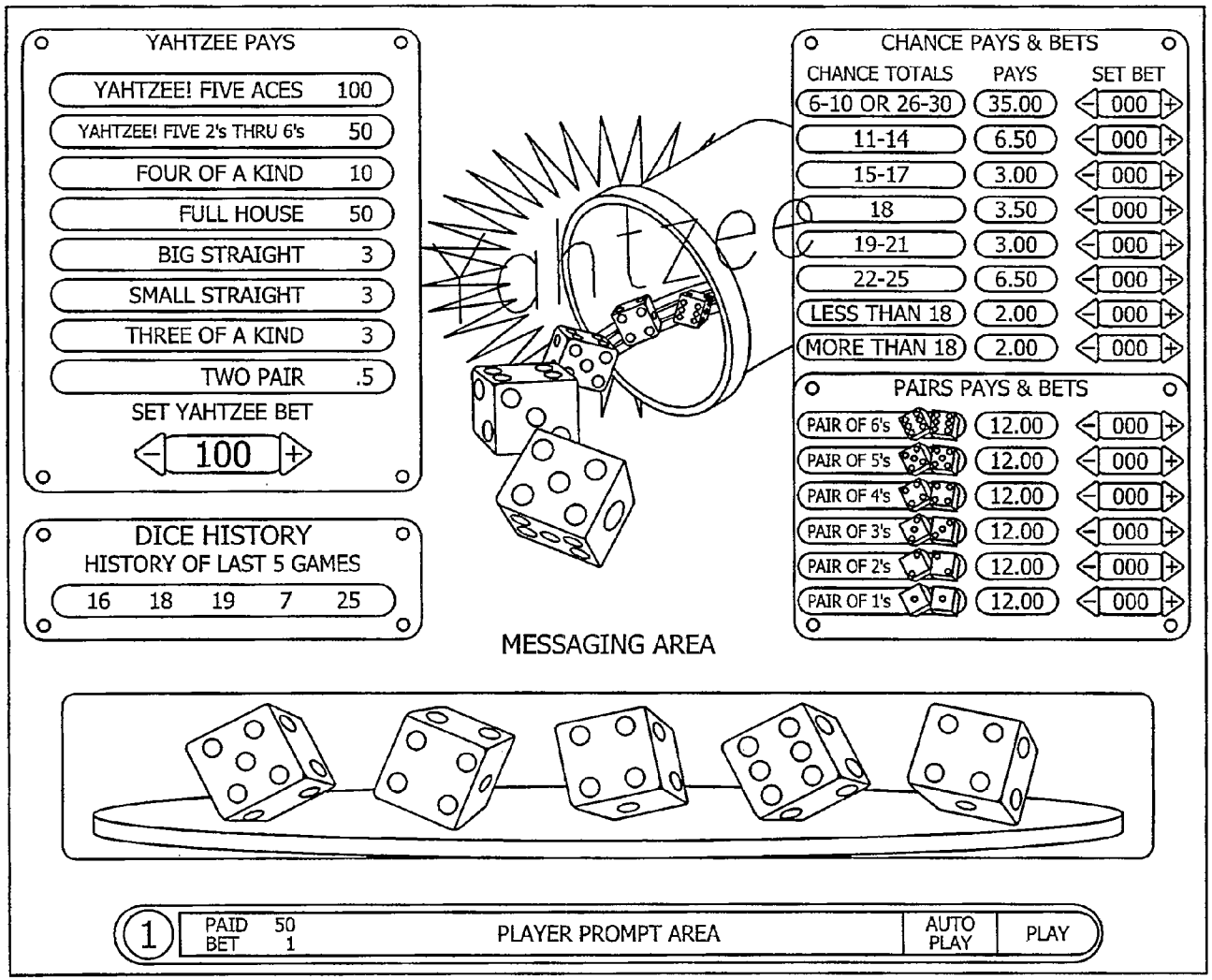
FIG. 17 shows a sample game screen-poker dice totals and pairs propositions.

FIG. 16 is a screen shot for a video game implementation of one embodiment of the present invention featuring a poker dice proposition and a color bet proposition. FIG. 17 is a screen shot for a video game implementation of one embodiment of the present invention featuring three propositions: a poker dice proposition, a totals range proposition and a number proposition.

Although the invention has been described in detail with reference to several embodiments, additional variations and modifications exist within the scope and spirit of the invention as described and defined in the following claims

I claim:

1. A method of controlling a wagering game comprising:

accepting at least one wager from a player, wherein the at least one wager is designated for a device providing plurality of groups of dice; and for each one of the groups:

(a) simulating a rolling of the dice of the group, each one of the dice having a plurality of sides, each one of the sides corresponding to an outcome, wherein the outcomes are determined before or during the simulated rolling of the dice;

(b) stopping the simulated rolling of the dice within the group one by one at different times, the simulated stopping beginning with an initial die in the group and ending with a last die in the group, each die indicating one of the outcomes after the stopping of the simulated rolling of the die;

(c) maintaining an opportunity to achieve at least one winning combination of the outcomes throughout a period, the period beginning upon the determination of the outcome corresponding to the initial die of the group, the period continuing until the determination of the outcome corresponding to the last die of the group, wherein the winning combination corresponds to a combination of the outcomes; and (d) providing an award as a result of the indicated outcomes satisfying the winning combination.

2. The method of claim 1, which includes indicating at least one combination of the outcomes based on the at least one wager.

3. The method of claim 1, wherein the at least one wager is associated with each of the groups of dice.

4. The method of claim 1, which includes: (a) associating the dice in at least one group with a plurality of different colors; and (b) associating at least one of the different colors with at least part of the at least one winning outcome.

5. The method of claim 4, which includes: (a) storing data representing a plurality of die faces associated with each die in at least one of the groups; and (b) associating a different color with each of at least two of the die faces of the die in the at least one group.

6. The method of claim 5, which includes accepting at least one wager that corresponds to at least one of the different colors.

7. The method of claim 1, which includes: (a) associating at least one bonus triggering condition with the dice in at least one group; and (b) indicating whether a combination of the indicated outcomes satisfies the at least one bonus triggering condition.

8. The method of claim 1, which includes accepting the at least one wager over a data network or internet.

9. The method of claim 1, which includes delaying the indication of the outcome of the last one of the dice in the at least one group of dice for a designated period of time.

10. The method of claim 9, which includes: (a) identifying at least one winning outcome which can occur based on a combination of the indicated outcomes; and (b) displaying the at least one identified winning outcome.

11. The method of claim 1, which includes determining a payback percentage based on: (a) the award associated with the at least one winning outcome; and (b) a probability of the at least one winning outcome being indicated.

12. A gaming system comprising:

at least one display device;

at least one input device;

at least one processor; and at least one memory device which stores a plurality of instructions, which when executed by the at least one processor, cause the at least one processor to operate with the at least one display device and the at least one input device to:

(a) accept at least one wager from a player, wherein the at least one wager is designated for a plurality of groups of dice; and (b) for each one of the groups:

(i) simulate a rolling of the dice of the group, each die having a plurality of sides, each one of the sides corresponding to an outcome, wherein the outcomes are determined before or during the simulated rolling of the dice;

(ii) stop the simulated rolling of the dice within the group one by one at different times, the simulated stopping beginning with an initial die in the group and ending with a last die in the group, each die indicating one of the outcomes after the stopping of the simulated rolling of the die;

(iii) maintain an opportunity to achieve at least one winning combination of the outcomes throughout a period, the period beginning upon the determination of the outcome corresponding to the initial die of the group, the period continuing until the determination of the outcome corresponding to the last die of the group, wherein the winning combination corresponds to a combination of the outcomes; and (iv) provide an award as a result of the indicated outcomes satisfying the winning combination.

13. The gaming system of claim 12, wherein a first wager is associated with a first one of the groups of dice and a second, different wager is associated with a second, different one of the groups of dice.

14. The gaming system of claim 12, wherein the memory device stores at least one instruction, which when executed by the at least one processor, causes the at least one processor to operate with the at least one display device and the at least one input device to: (a) associate the dice in at least one of the groups of dice with a plurality of different colors; and (b) associate at least one of the different colors with at least part of the at least one winning outcome.

15. The gaming system of claim 14, wherein the memory device stores at least one instruction, which when executed by the at least one processor, causes the at least one processor to operate with the at least one display device and the at least one input device to accept at least one wager that corresponds to at least one of the different colors.

16. The gaming system of claim 12, wherein the memory device stores at least one instruction, which when executed by the at least one processor, causes the at least one processor to operate with the at least one display device and the at least one input device to: (a) associate at least one bonus triggering condition with the dice in at least one of the groups of dice; and (b) indicate whether a combination of the indicated outcomes satisfies the at least one bonus triggering condition.

17. The gaming system of claim 12, wherein the memory device stores at least one instruction, which when executed by the at least one processor, causes the at least one processor to operate with the at least one display device and the at least one input device to accept the at least one wager over a data network or internet.

18. The gaming system of claim 12, wherein the memory device stores at least one instruction, which when executed by the at least one processor, causes the at least one processor to operate with the at least one display device and the at least one input device to delay the indication of the outcome of the last die in the at least one group of dice for a designated period of time.

19. The gaming system of claim 12, wherein the memory device stores at least one instruction, which when executed by the at least one processor, causes the at least one processor to operate with the at least one display device and the at least one input device to: (a) identify at least one winning outcome which can occur based on a combination of the indicated outcomes; and (b) display the at least one identified winning outcome.

20. A gaming system comprising:

at least one display device;

at least one input device;

at least one processor; and at least one memory device which stores: (1) data corresponding to a plurality of outcomes; and (2) a plurality of instructions, which when executed by the at least one processor, cause the at least one processor to operate with the at least one display device and the at least one in put device to:

(a) accept at least one wager from a player, wherein the at least one wager is designated for: (i) at least one group of dice; and (ii) at least one additional die;

(b) for the at least one group:

(i) simulate a rolling of the dice of the at least one group, each die having a plurality of sides, each one of the sides corresponding to one of the outcomes; and (ii) stop the simulated rolling of the dice within the at least one group, each die indicating one of the outcomes after the stopping of the simulated rolling of the die;

(c) for the at least one additional die:

(i) simulate a rolling of the at least one additional die, the at least one additional die having a plurality of sides, each one of the sides corresponding to one of the outcomes; and (ii) stop the simulated rolling of the at least one additional die, the at least one additional die indicating one of the outcomes after the stopping of the simulated rolling of the at least one additional die;

(d) maintain an opportunity to achieve at least one winning combination of the outcomes throughout a period, the period beginning before the stopping of the simulated rolling of the die of the at least one group and the at least one additional die, the period continuing until the outcomes are determined for all of the dice within the at least one group and the at least on additional die, the winning combination corresponding to a combination of the determined outcomes; and (e) provide an award as a result of the determined outcomes satisfying the winning combination.

21. The gaming system of claim 20, wherein a first wager is associated with the at least one group of dice and a second, different wager is associated with the least one additional die.

22. The gaming system of claim 20, wherein the memory device stores at least one instruction, which when executed by the at least one processor, causes the at least one processor to operate with the at least one display device and the at least one input device to: (a) associate at least one bonus triggering condition with a plurality of the dice; and (b) indicate whether a combination of the indicated outcomes satisfies the at least one bonus triggering condition.

23. The gaming system of claim 20, wherein the memory device stores at least one instruction, which when executed by the at least one processor, causes the at least one processor to: (x) receive a stop input from a player; and (y) after receiving the stop input, performing step (b)(ii).

* * * * *

UNITED STATES PATENT AND TRADEMARK OFFICE

CERTIFICATE OF CORRECTION

PATENT NO. : 7,624,986 B2
APPLICATION NO. : 11/187354
DATED : December 1, 2009
INVENTOR(S) : Mark C. Nicely It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 253 days.

Signed and Sealed this

Twenty-sixth Day of October, 2010

David J. Kappos

David J. Kappos
*Director of the United States Patent and Trademark Office*